US010842237B2

(12) United States Patent
Takano

(10) Patent No.: US 10,842,237 B2
(45) Date of Patent: Nov. 24, 2020

(54) ELECTRONICS STAND

(71) Applicant: Fujitsu Client Computing Limited, Kanagawa (JP)

(72) Inventor: Minoru Takano, Kawasaki (JP)

(73) Assignee: FUJITSU CLIENT COMPUTING LIMITED, Kanagawa (JP)

( * ) Notice: Subject to any disclaimer, the term of this patent is extended or adjusted under 35 U.S.C. 154(b) by 22 days.

(21) Appl. No.: 16/439,797

(22) Filed: Jun. 13, 2019

(65) Prior Publication Data

US 2020/0178662 A1 Jun. 11, 2020

(30) Foreign Application Priority Data

Dec. 5, 2018 (JP) ..... 2018-228506

(51) Int. Cl.
*F16M 13/00* (2006.01)
*A45C 11/00* (2006.01)
*A47B 23/04* (2006.01)

(52) U.S. Cl.
CPC ..... *A45C 11/00* (2013.01); *A47B 23/044* (2013.01); *A45C 2011/002* (2013.01); *A45C 2011/003* (2013.01); *A45C 2200/15* (2013.01)

(58) Field of Classification Search
CPC .... G06F 1/1632; G06F 1/1652; G06F 1/1626; H05K 5/0226
USPC ..... 248/441.1, 447.1, 455, 459, 460
See application file for complete search history.

(56) References Cited

U.S. PATENT DOCUMENTS 8,434,601 B2 * 5/2013 Hou ..... A47B 23/043 190/1
8,950,720 B1 * 2/2015 Carr ..... F16M 11/10 248/460
9,227,763 B2 * 1/2016 Gengler ..... G06F 1/16
10,302,243 B1 * 5/2019 Scholz ..... A47B 23/044
10,698,452 B2 * 6/2020 Fenton ..... G06F 1/166
2006/0081758 A1 * 4/2006 Lee ..... G06F 15/0062 248/459

(Continued)

FOREIGN PATENT DOCUMENTS

JP 3182556 U 4/2013
JP 2015092317 A 5/2015

(Continued)

OTHER PUBLICATIONS

Decision to Grant a Patent issued in corresponding Japanese patent application No. JP2018-228506 dated Mar. 5, 2019 (5 pages).

*Primary Examiner* — Steven M Marsh
(74) *Attorney, Agent, or Firm* — Osha Bergman Watanabe & Burton LLP

(57) ABSTRACT

An electronics stand includes: a mount on which an electronic device is mounted where the mount and the electronic device are an assembly; and a plate member coupled to the mount. The plate member includes: a first plate having a first side connected to the mount and a second side opposite the first side; a second plate having a first side foldably connected to the second side of the first plate and a second side opposite the first side of the second plate; a restrictor including a first part foldably connected to the first plate and a second part foldably connected to the first part and to the second plate; and a third plate having a first side foldably connected to the second plate.

4 Claims, 8 Drawing Sheets

(56) References Cited

U.S. PATENT DOCUMENTS

| | | | |
|---|---|---|---|
| 2015/0083615 | A1 | 3/2015 | Lay et al. |
| 2015/0374118 | A1 | 12/2015 | van Hooft et al. |

FOREIGN PATENT DOCUMENTS

| | | | |
|---|---|---|---|
| JP | 2016534449 | A | 11/2016 |
| WO | 2015023414 | A1 | 2/2015 |

* cited by examiner

ELECTRONICS STAND

CROSS-REFERENCE TO RELATED APPLICATIONS

This application claims priority from Japanese Patent Application No. 2018-228506 filed Dec. 5, 2018, the entire contents of which are incorporated herein by reference.

FIELD

Embodiments described herein relate generally to an electronics stand.

BACKGROUND

Conventionally, electronics stands are known which include a plate member changeable in posture between an expanded form and a folded form. Such an electronics stand includes a cover function in which the expanded plate member covers a display screen of an electronic device such as a tablet personal computer and a stand function in which the folded plate member supports the back side of the electronic device to place the electronic device in standing position at a given angle. In addition, electronic devices are known which incorporate, on part of the back face, an antenna for use in near field wireless communication, to perform wireless communication with another near field wireless communication device of a compact information terminal such as a smartphone that is placed on the back face of the electronic device.

To perform wireless communication between the electronic device supported by the electronics stand from the back side and the information terminal, the electronic device is removed from the electronics stand, for example, to open the back face of the electronic device.

It is thus preferable to provide an electronics stand that enables another electronic device to be placed between the electronics stand and the back face of an electronic device supported by the electronics stand.

SUMMARY

According to one or more embodiments, in general, an electronics stand includes a mount on which an electronic device is mounted, the mount and the electronic device that constitute an assembly; and a plate member coupled to the mount. The plate member includes a first plate having a first side connected to the mount, and a second side opposite the first side; a second plate having a first side foldably connected to the second side of the first plate, and a second side opposite the first side; a restrictor including a first part foldably connected to the first plate, and a second part foldably connected to the first part and to the second plate; and a third plate having a first side foldably connected to the second plate. The second side of the second plate includes a connection connected to the third plate, and a support located anterior to the connection in a direction from the first side of the second plate to the second side of the second plate. The plate member is changeable in posture between an expanded form and a folded form. The expanded form is a form in which the first plate, the second plate, the third plate, and the restrictor are expanded. The folded form is a form in which the second plate is folded with respect to the first plate and placed on the second part such that the support of the second plate supports a back face of the electronic device, the restrictor limits folding of the second plate with respect to the first plate, the third plate is folded from the second plate toward the first plate, and a back face of the assembly and the third plate are placed with a gap in-between.

DETAILED DESCRIPTION

The following discloses an exemplary embodiments of the present invention. Configurations of the following embodiments and operations and effects achieved by the configurations are merely exemplary. The present invention can be implemented by any configuration other than the configurations disclosed in the following embodiments. The embodiments can attain at least one of a variety of effects (including derivative effects) achieved by the configurations.

In this disclosure, ordinal numbers are used only for distinguishing components, parts, members, portions, positions, directions, and the like, and are unintended to indicate any order or priority.

Figure 1:
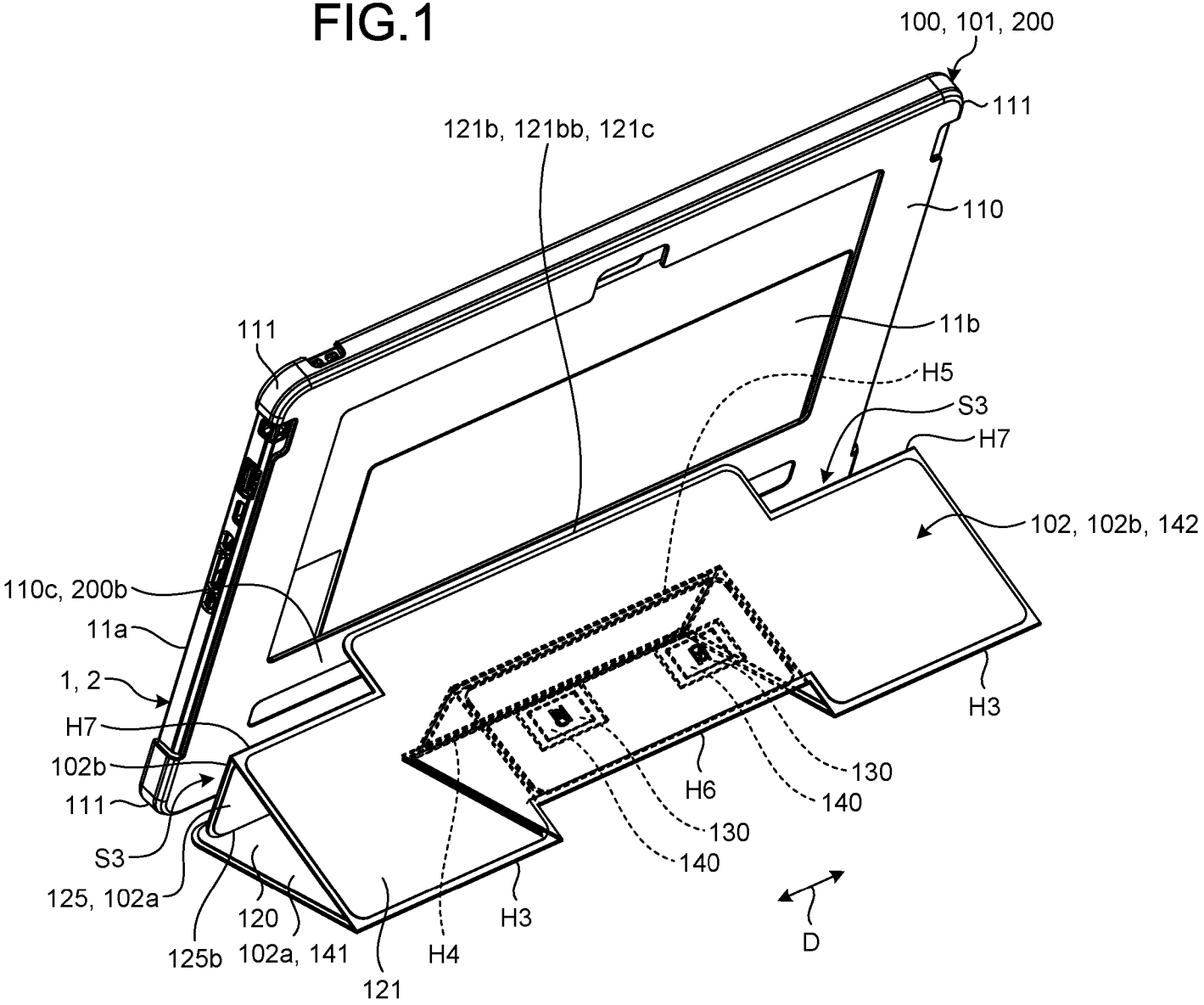
FIG. 1 is an exemplary perspective view of an electronics stand according to one or more embodiments, while a folded plate member supports an electronic device.
Figure 2:
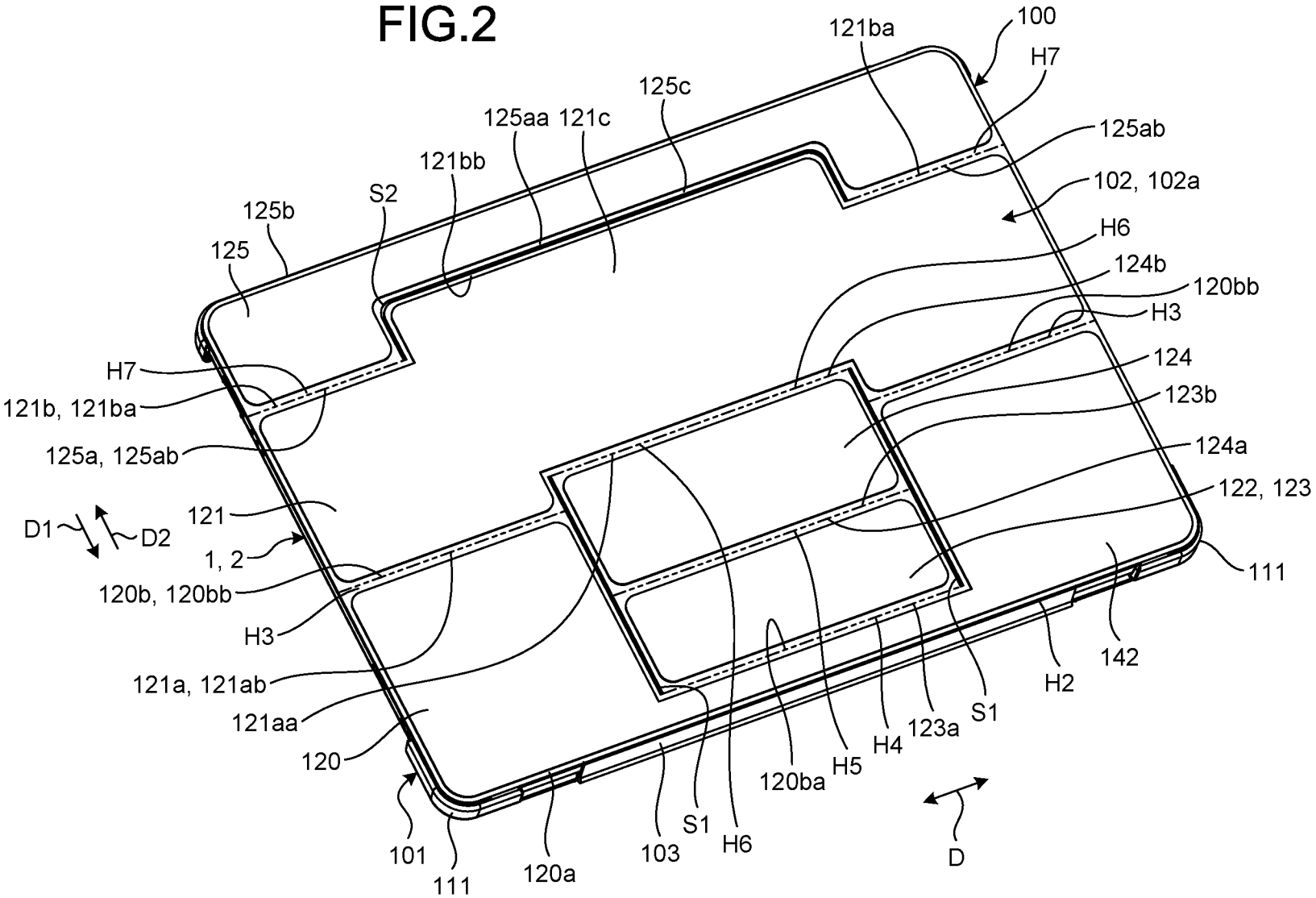
FIG. 2 is an exemplary perspective view of the electronics stand according to one or more embodiments, while an expanded plate member covers a front face of the electronic device.

FIG. 1 is an exemplary perspective view of an electronics stand 100 according to one or more embodiments, while a plate member 102 is folded to support an electronic device 1. FIG. 2 is an exemplary perspective view of the electronics stand 100 according to one or more embodiments, while the plate member 102 is expanded to cover the front face of the electronic device 1.

As illustrated in FIGS. 1 and 2, the electronics stand 100 includes a mount 101, the plate member 102, and a connector 103. The electronic device 1 is mounted on the mount 101. The connector 103 connects the mount 101 and the plate member 102. The plate member 102 is changeable in posture between a folded form (FIG. 1) and an expanded form (FIG. 2). The electronics stand 100 includes a stand function (FIG. 1) and a cover function (FIG. 2). In the stand function, the folded plate member 102 works to stand the electronic device 1 on the mount surface at a given angle relative to the mount surface. In the cover function, the expanded plate member 102 serves to cover a front face 11*a* of the electronic device 1. The folded form is also referred to as a folded posture. The expanded form is also referred to as an expanded posture. The electronics stand 100 is also referred to as an electronics cover stand.

Figure 3:
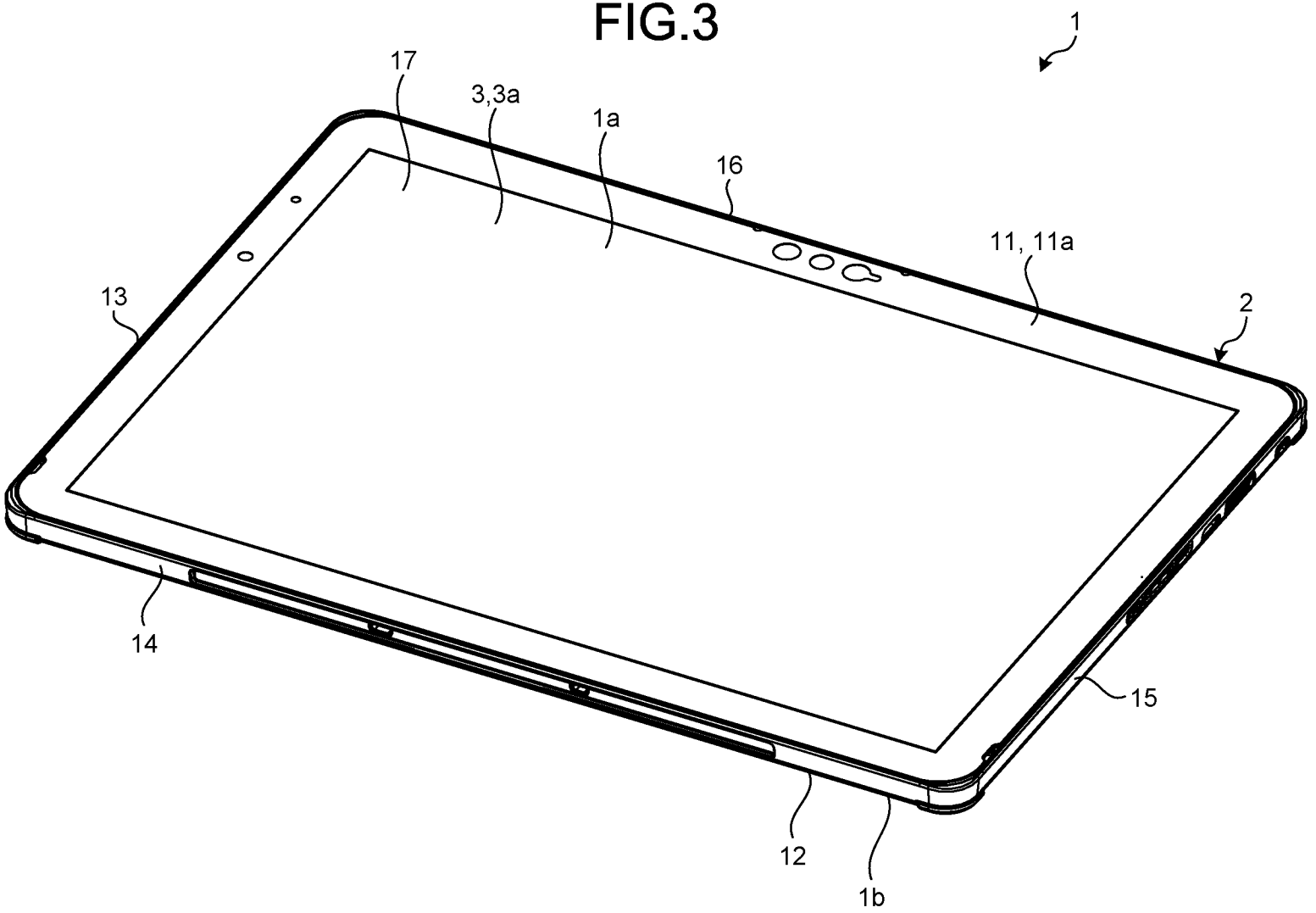
FIG. 3 is an exemplary perspective view of the electronic device according to one or more embodiments.

FIG. 3 is an exemplary perspective view of the electronic device 1 according to one or more embodiments. As illustrated in FIG. 3, the electronic device 1 represents, for example, a tablet personal computer. The electronic device 1 is not limited to such an example and may be, for example, a video display, a television receiver, a gaming machine, a video display controller, and an information storage.

In the following, with reference to the electronic device 1 in a standing or upright position held by the electronics stand 100 (FIG. 1) as viewed from a user of the electronic device 1, a side closer to the user is referred to as a front side (anterior) and a side remote from the user is referred to as a rear side (posterior). A height direction of the electronic device 1 is also referred to as a vertical direction and a width direction of the electronic device 1 is also referred to as a crosswise direction D.

The electronic device 1 has a front face 1*a* being an anterior face and a back face 1*b* being a posterior face. The electronic device 1 includes a housing 2. The housing 2 houses a display unit 3 and other components such as a wireless communication device.

The housing 2 has a flat, substantially parallelepiped box shape. The housing 2 has a front wall 11 to which a display screen 3*a* of the display unit 3 is exposed, a back wall 12 opposite the front wall 11, and a plurality of side walls 13 to 16 extending between the front wall 11 and the back wall 12.

The front wall 11 has a quadrilateral shape, specifically, a rectangular shape in a front view. The front face 11*a* of the front wall 11 and the display screen 3*a* are covered by a transparent member 17. The front face of the transparent member 17 serves as the front face 1*a* of the electronic device 1. The back wall 12 has a quadrilateral shape, specifically, a rectangular shape in a front view. The back face of the back wall 12 serves as the back face 1*b* of the electronic device 1.

Figure 4:
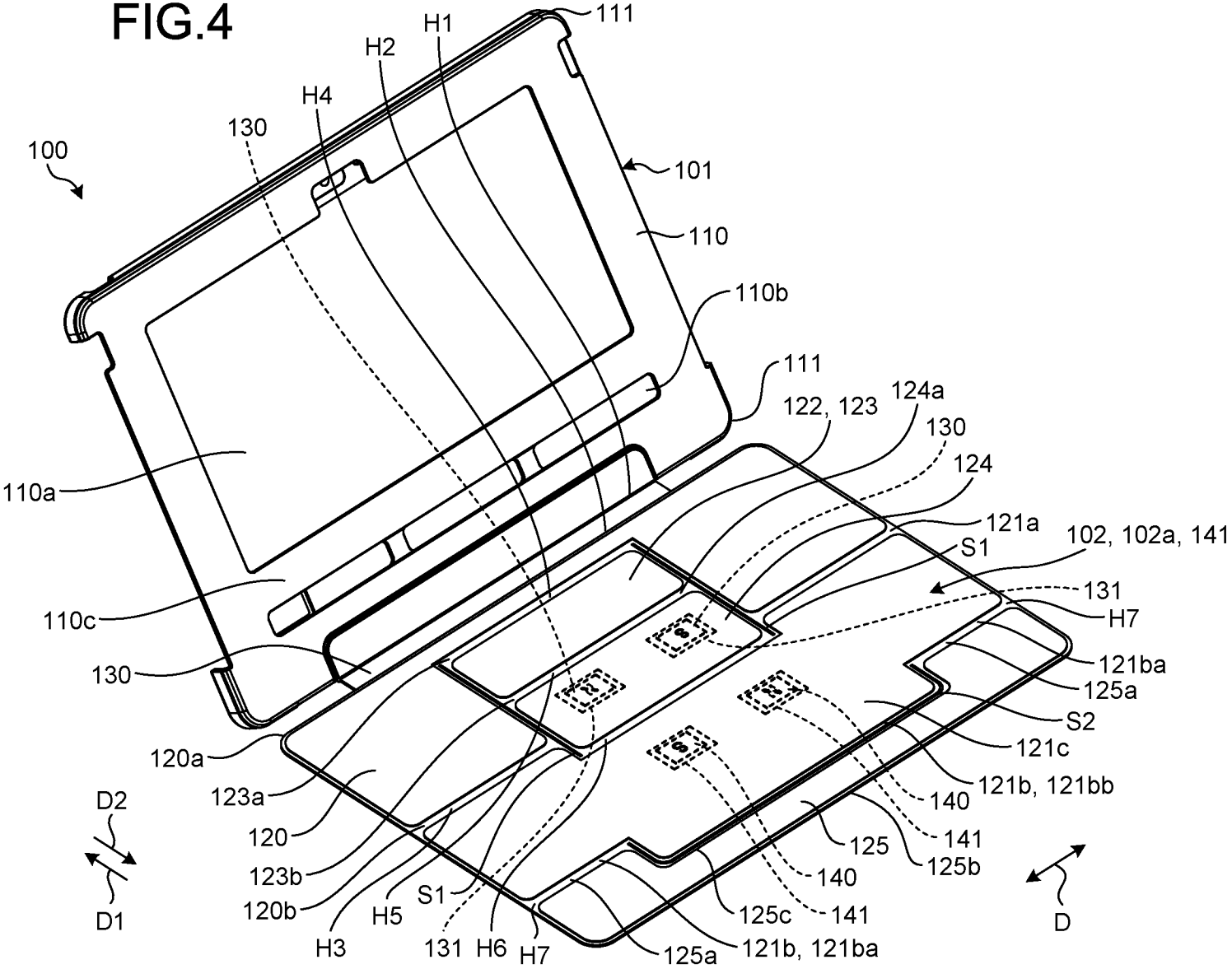
FIG. 4 is an exemplary perspective view of the electronics stand according to one or more embodiments, while the expanded plate member is away from a mount.

The following describes the electronics stand 100 in detail. FIG. 4 is an exemplary perspective view of the electronics stand 100 according to one or more embodiments, while the expanded plate member 102 is separated from the mount 101.

As illustrated in FIG. 4, the mount 101 includes a wall 110 and four corner supports 111. The wall 110 has a quadrilateral shape, specifically, a rectangular shape in a front view. The wall 110 is provided with an opening 110*a* and a plurality of openings 110*b*. The opening 110*a* and the openings 110*b* pass through the wall 110 along the thickness. The openings 110*b* are located below the opening 110*a* and aligned with spacing in the crosswise direction D. A part of the wall 110 between the opening 110*a* and the openings 110*b* serves as an extension 110*c* extending in the crosswise direction D.

The corner supports 111 are disposed at the four respective corners of the wall 110. The corner supports 111 extend forward from the wall 110. The two top corner supports 111 are integrated together. The two bottom corner supports 111 are integrated together.

The electronic device 1 is removably mounted on the mount 101 as configured above. While the electronic device 1 is mounted on the mount 101, the wall 110 contacts and supports the back face 1*b* of the electronic device 1 and the four corner supports 111 contact and support the four corners of the electronic device 1. The mount 101 and the electronic device 1 mounted thereon form an assembly 200.

The connector 103 extends between a lower side of the mount 101 and a first (lower) side 120*a* of the plate member 102. The connector 103 is foldably connected to the lower side of the mount 101 with a hinge H1 which extends in the crosswise direction D, and is foldably connected to the first side 120*a* of the plate member 102 with a hinge H2 which extends in the crosswise direction D. The connector 103 connects the plate member 102 to the mount 101 such that the plate member 102 is foldable to the front side and the back side of the mount 101.

Figure 5:
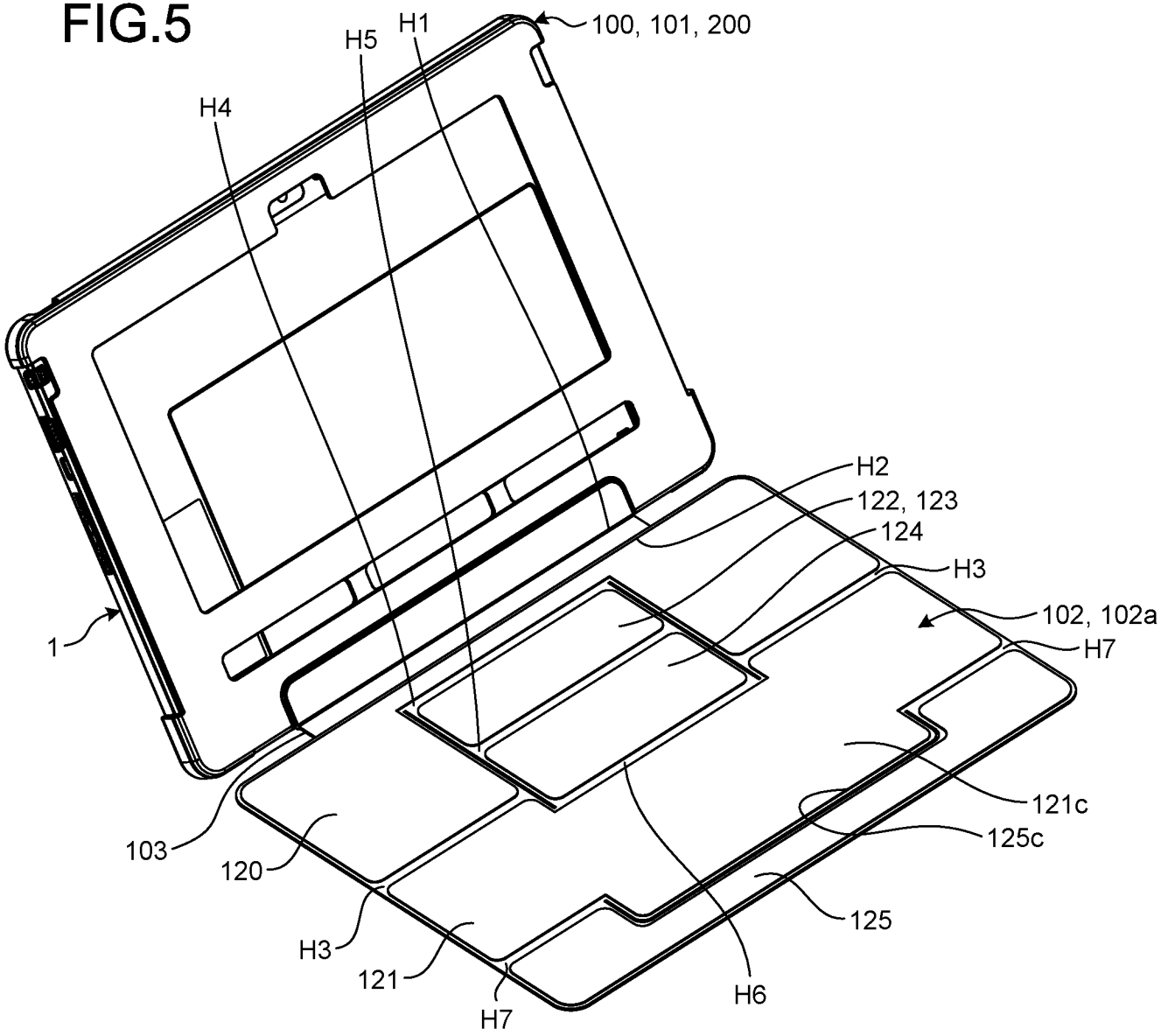
FIG. 5 is an exemplary perspective view of the electronics stand according to one or more embodiments, while the electronic device is mounted on the mount and the expanded plate member is away from the mount.
Figure 6:
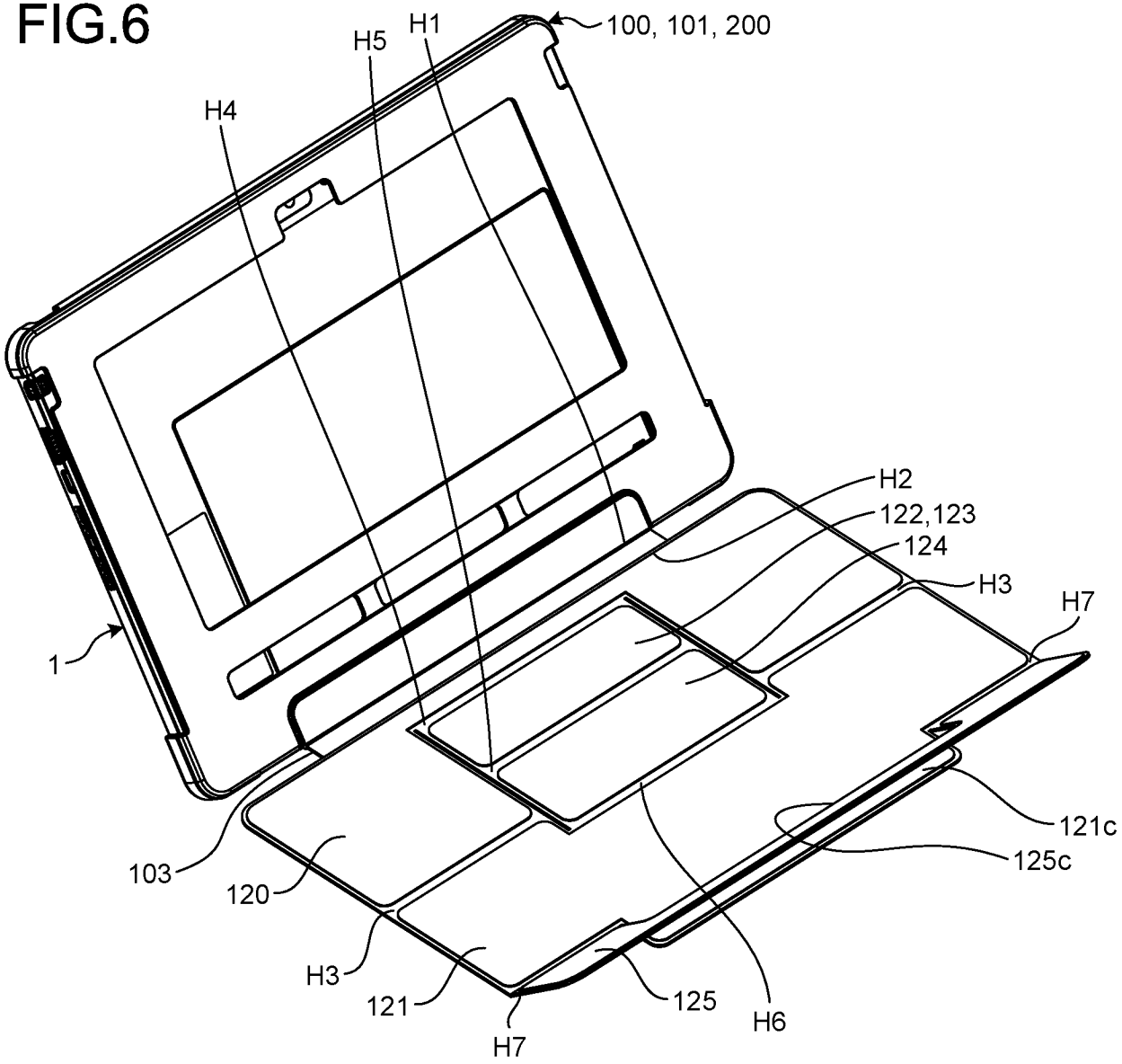
FIG. 6 is an exemplary perspective view of the electronics stand according to one or more embodiments, while the electronic device is mounted on the mount and the partially folded plate member is away from the mount.
Figure 7:
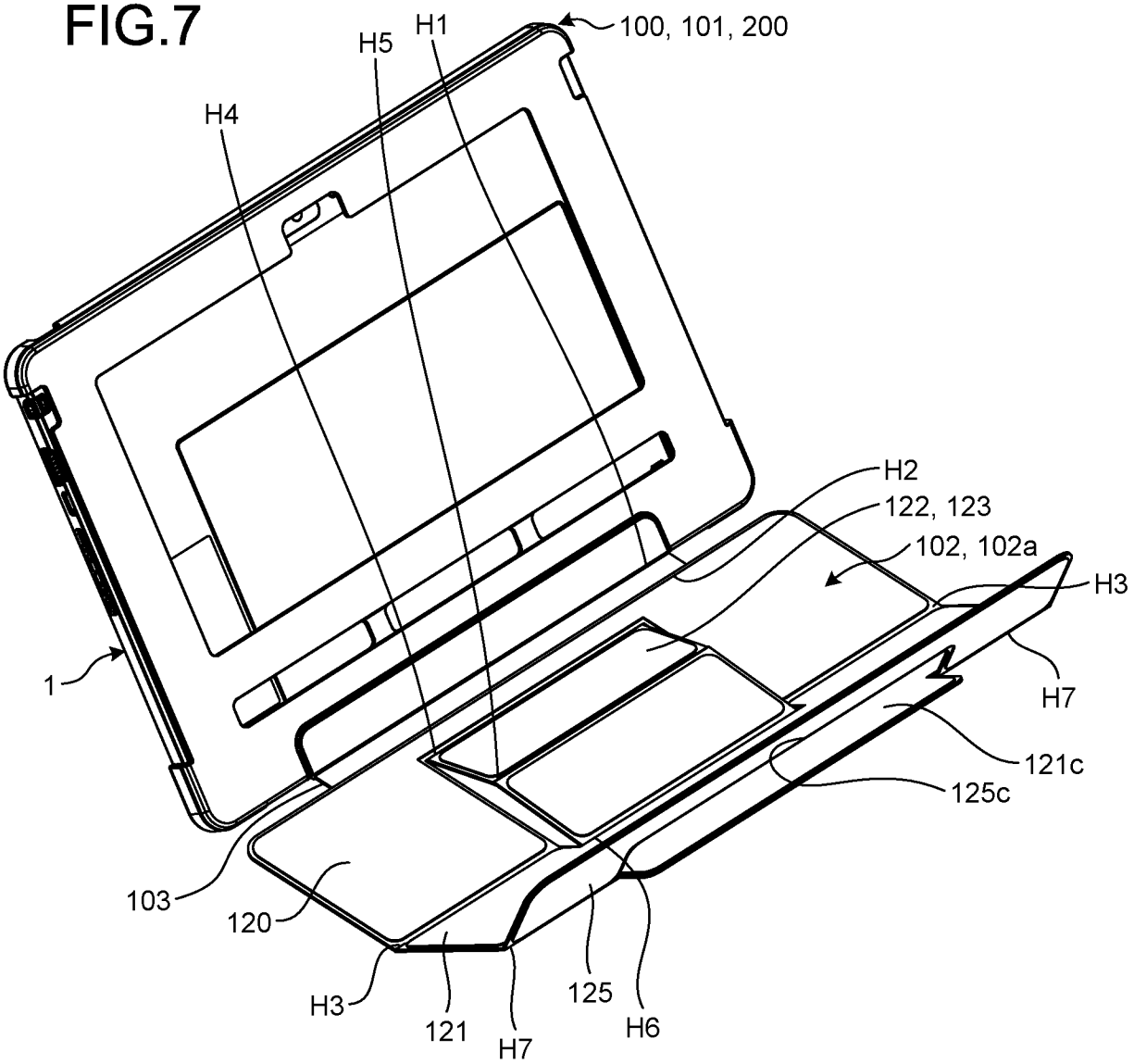
FIG. 7 is an exemplary perspective view of the electronics stand according to one or more embodiments, while the electronic device is mounted on the mount and the plate member is folded further than in FIG. 6.

FIG. 5 is an exemplary perspective view of the electronics stand 100 according to one or more embodiments, while the electronic device 1 is mounted on the mount 101 and the plate member 102 is expanded away from the mount 101. FIG. 6 is an exemplary perspective view of the electronics stand 100 according to one or more embodiments, while the electronic device 1 is mounted on the mount 101 and the plate member 102 is partially folded away from the mount 101. FIG. 7 is an exemplary perspective view of the electronics stand 100 according to one or more embodiments, while the electronic device 1 is mounted on the mount 101 and the plate member 102 is folded further than in FIG. 6.

As illustrated in FIGS. 4 to 8, the plate member 102 has a first face 102*a* and a second face 102*b* opposite the first face 102*a*.

The plate member 102 includes a first plate 120, a second plate 121, a third plate 125, a restrictor 122, a plurality of magnets 130 and 140, and a plurality of magnetic shield members 131 and 141.

Referring to FIG. 2, the first plate 120 has the first side 120*a* and a second side 120*b* opposite the first side 120*a*. The first side 120*a* of the first plate 120 is closer to the connector 103 and extends in the crosswise direction D. The first side 120*a* is foldably connected to the connector 103 with the hinge H2. The second side 120*b* includes a first part 120*ba* and two second parts 120*bb*. The two second parts 120*bb* are located anterior to the first part 120*ba* in a direction D2 from the first side 120*a* to the second side 120*b*. The first part 120*ba* is located between the two second parts 120*bb*. The first part 120*ba* and the two second parts 120*bb* each extend in the crosswise direction D. That is, the second side 120*b* extends in the crosswise direction D.

The second plate 121 has a first side 121*a* and a second side 121*b* opposite the first side 121*a*.

The first side 121*a* includes a first part 121*aa* and two second parts 121*ab*. The two second parts 121*ab* are located anterior to the first part 121*aa* in a direction D1 from the second side 121*b* to the first side 121*a*. The first part 121*aa* is located between the two second parts 121*ab*. The first part 121*aa* and the two second parts 121*ab* each extend in the crosswise direction D. That is, the first side 121*a* extends in the crosswise direction D. The two second parts 121*ab* are foldably connected to the two respective second parts 120*bb* of the second side 120*b* of the first plate 120 with a hinge H3.

The second side 121*b* includes two connections 121*ba* and a support 121*bb*. The two connections 121*ba* are located at both ends of the second side 121*b* in the crosswise direction D. The support 121*bb* is located anterior to the two connections 121*ba* in the direction D2 from the first side 121*a* to the second side 121*b*. The support 121*bb* is located between the two connections 121*ba*. The two connections 121*ba* and the support 121*bb* each extend in the crosswise direction D. That is, the second side 121*b* extends in the crosswise direction D.

The second plate 121 further includes a protrusion 121*c*. The protrusion 121*c* includes the support 121*bb* and is located between the two connections 121*ba*. The protrusion 121*c* protrudes from the two connections 121*ba* in the direction D2 from the first side 121*a* to the second side 121*b*. In the expanded state of the plate member 102, a slit S2 lies along the protrusion 121*c*.

While the second plate 121 configured as above is folded with respect to the first plate 120 such that the first face 102*a* of the second plate 121 faces the first face 102*a* of the first plate 120, and the third plate 125 is folded with respect to the second plate 121, the support 121*bb* of the second side 121*b* supports a back face 11*b* of the electronic device 1 (FIG. 1). The support 121*bb* abuts on the extension 110*c* of the mount 101.

As illustrated in FIG. 2, the third plate 125 has a first side 125*a* and a second side 125*b* opposite the first side 125*a*.

The first side 125*a* includes a first part 125*aa* and two second parts 125*ab*. The first part 125*aa* is located anterior to the two second parts 125*ab* in the direction D2 from the first side 125*a* to the second side 125*b*. The first part 125*aa* is located between the two second parts 125*ab*. The first part 125*aa* and the two second parts 125*ab* each extend in the crosswise direction D. That is, the first side 125*a* extends in the crosswise direction D. The two second parts 125*ab* are foldably connected to the respective connections 121*ba* of the second side 121*b* of the second plate 121 with hinges H7. The second parts 125*ab* are spaced apart from the second plate 121.

The third plate 125 is provided with a recess 125*c* in which the protrusion 121*c* is received in the expanded form.

Referring to FIG. 1, in the folded state, the third plate 125 as configured above is folded with respect to the second plate 121 such that the second face 102*b* of the third plate 125 faces a back face 200*b* of the assembly 200. In this state, a gap S3 lies between the back face 200*b* of the assembly 200 and the third plate 125. In one or more embodiments, there are two gaps S3 with an interval in the crosswise direction D. The gaps S3 are open upward and laterally. The gaps S3 are also referred to as accommodation spaces.

As illustrated in FIG. 2, the restrictor 122 has a plate shape and includes a first part 123 and a second part 124. The restrictor 122 restricts or regulates the second plate 121 from being folded with respect to the first plate 120 so as to prevent the angle between the first plate 120 and the second plate 121 from lowering below a given angle. Specifically, the restrictor 122 maintains the angle between the first plate 120 and the second plate 121 at a given angle. The restrictor 122 is also referred to as a regulator.

The first part 123 has a first side 123*a* and a second side 123*b* opposite the first side 123*a*. The first side 123*a* is foldably connected to the first part 120*ba* of the second side 120*b* of the first plate 120 with a hinge H4. The first side 123*a* and the second side 123*b* extend in the crosswise direction D.

The second part 124 has a first side 124*a* and a second side 124*b* opposite the first side 124*a*. The first side 124*a* is foldably connected to the second side 123*b* of the first part 123 with a hinge H5. The second side 124*b* is foldably connected to the first part 121*aa* of the first side 121*a* of the second plate 121 with a hinge H6. The first side 124*a* and the second side 124*b* extend in the crosswise direction D. In the expanded state of the plate member 102A, a slit S1 lies on both lateral sides of the restrictor 122. The first part 123 and the second part 124 are also referred to as plates.

In the folded form of the plate member 102 (FIG. 1), the second part 124 and the second plate 121 are placed on top of each other, with a first face 102*a* of the second part 124 of the restrictor 122 in contact with a first face 102*a* of the second plate 121, and the first part 123 stretching between the first plate 120 and the second plate 121. Thereby, the restrictor 122 restricts the folding of the second plate 121 with respect to the first plate 120.

The plate member 102 includes a core material (not illustrated) and a cover member 142 (FIG. 2, for example) covering the core material. The core material is formed of, for example, a synthetic resin material. The cover member 142 is formed of, for example, leather or synthetic leather (artificial leather). The hinges H1 to H7 are each formed of the cover member 142 without the core material. Thus, the hinges H1 to H7 are elastically foldable, and when folded, generate an elastic force as resilience.

The plate member 102 as configured above is changeable in posture between the expanded form (FIG. 2) and the folded form (FIG. 1), as described above. In the expanded form (FIG. 2), the first plate 120, the second plate 121, the third plate 125, and the restrictor 122 are expanded.

In the folded form (FIG. 1), the second plate 121 is folded with respect to the first plate 120 and placed on the second part 124 such that the support 121*bb* of the second side 121*b* of the second plate 121 supports the back face 1*b* of the electronic device 1, the restrictor 122 limits the folding of the second plate 121 with respect to the first plate 120, and the third plate 125 is folded from the second plate 121 toward the first plate 120. This places the back face 200*b* of the assembly 200 and the third plate 125 with the gaps S3 in-between.

To change the posture of the plate member 102 from the expanded form in FIG. 2 to the folded form in FIG. 1, the user folds the plate member 102 toward the back face of the mount 101 on which the electronic device 1 is mounted (FIG. 5). The user then folds the third plate 125 so that the second side 125*b* of the third plate 125 approaches the back face 200*b* of the assembly 200 (FIG. 6), and folds the second plate 121 so that the second side 121*b* of the second plate 121 approaches the back face 200*b* of the assembly 200. Through such series of folding, the first part 123 and the second part 124 of the restrictor 122 are folded, placing the plate member 102 in the folded state (FIG. 1).

Figure 8:
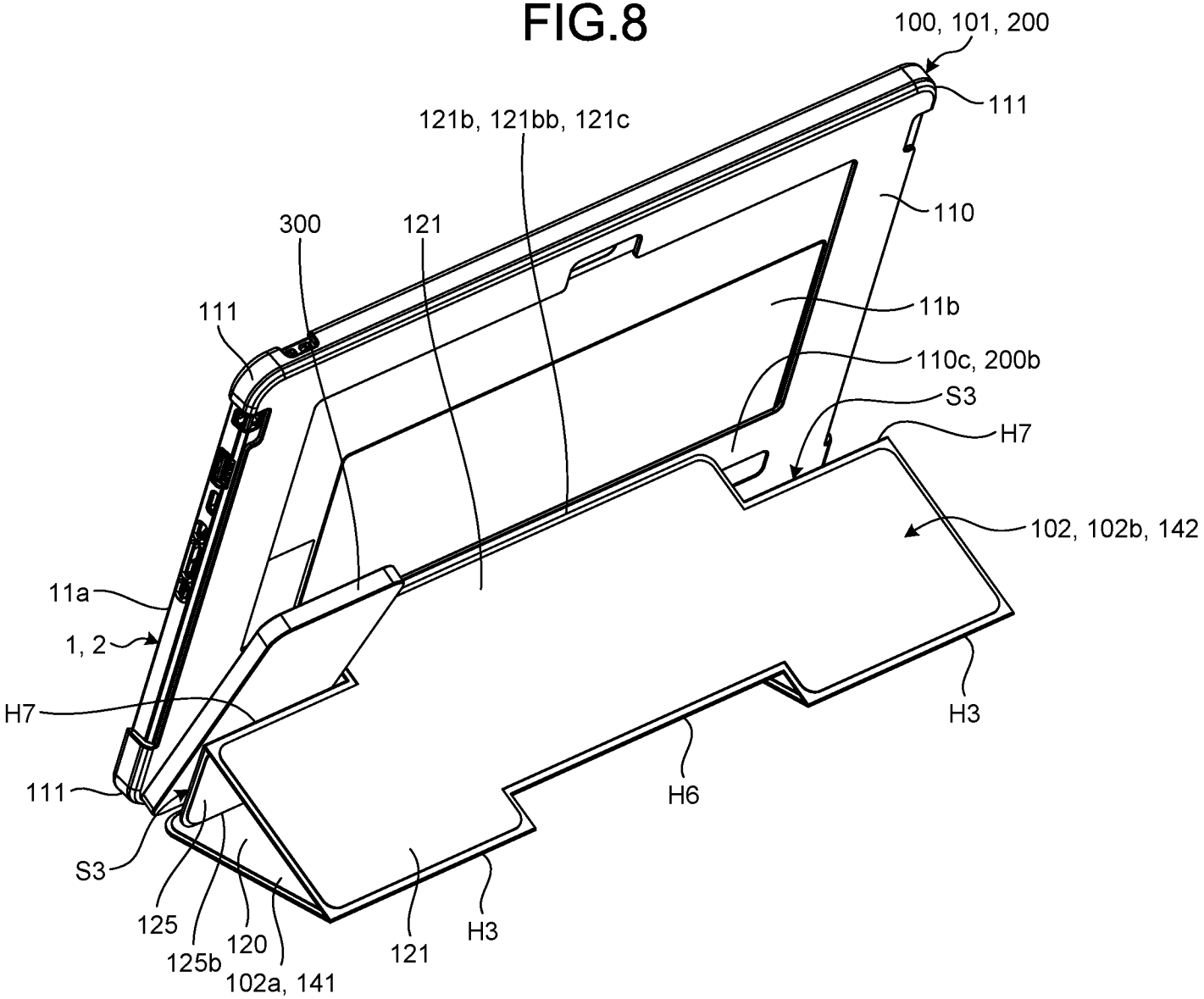
FIG. 8 is an exemplary perspective view of the electronics stand according to one or more embodiments, while an information terminal is inserted into a gap between the folded plate member and an assembly.

FIG. 8 is an exemplary perspective view of the electronics stand 100 according to one or more embodiments, while an information terminal 300 is inserted into the gaps S3 between the folded plate member 102 and the assembly 200. As illustrated in FIG. 8, the gaps S3 between the plate member 102 and the assembly 200 are large enough to allow the information terminal 300 of a given size to be inserted therein. The information terminal 300 incorporates a near field wireless communication device and can wirelessly communicate with a near field wireless communication device of the electronic device 1. While the information terminal 300 is inserted in the gaps S3 and supported by the electronics stand 100, the antenna for the near field wireless communication device is located to be communicable with the antenna of the near field wireless communication device of the electronic device 1. The information terminal 300 represents, for example, a smartphone or a cellular phone. The electronic device to be inserted in the gaps S3 may be other devices than the information terminal 300. The near field wireless communication device represents, for example, a near field communication (NFC). The information terminal 300 is also referred to as another electronic device.

The following describes the magnets 130 and 140 and the magnetic shield members 131 and 141. As illustrated in FIG.

4, the second part 124 of the restrictor 122 and the second plate 121 are provided with the magnets 130 and 140. The magnets 130 and 140 are an exemplary magnetic material that generates a magnetic force.

The second part 124 are provided with two magnets 130 aligned with spacing in the crosswise direction D. The second plate 121 is provided with two magnets 140 aligned with spacing in the crosswise direction D. In the folded form, the two magnets 130 and the two magnets 140 are juxtaposed in the direction in which the second plate 121 and the second part 124 are placed on top of each other, that is, along the thickness of the second plate 121 and the second part 124.

The second part 124 and the second plate 121 are provided with the magnetic shield members 131 and the magnetic shield members 141, respectively. The magnetic shield members 131 and the magnetic shield members 141 are disposed outside the magnets 130 and the magnets 140, respectively, in the overlapping direction of the second plate 121 and the second part 124. The magnetic shield members 131 and the magnetic shield members 141 are each formed of a magnetic material such as iron or tinplate. The magnetic shield members 131 and the magnetic shield members 141 are not magnetized. The magnetic shield members 131 and the magnetic shield members 141 function as yokes that enhance the magnetic force of first faces of the magnets 130 and the magnets 140, the first faces opposite second faces on which the magnetic shield members 131 and the magnetic shield members 141 are placed, and weakens the magnetic force of the second faces. The magnetic shield members 131 may be magnetized if they can function to strengthen the magnetic force of the first faces of the magnets 130 and weaken the magnetic force of the second faces of the magnets 130.

As configured above, in the folded form (FIG. 1) the magnets 140 in the second plate 121 and the magnets 130 in the second part 124 are juxtaposed with each other in the overlapping direction of the second plate 121 and the second part 124 and coupled together by magnetic force. The magnetic shield members 131 and 141 are located outside the magnets 130 and 140 in the overlapping direction of the second plate 121 and the second part 124, to weaken the magnetic force of the magnets 130 and 140 toward the outside.

Further, in the folded form, the magnets 140 in the second plate 121 and the magnets 130 in the second part 124 are coupled together by the magnetic force against the elastic force occurring from the elastic deformation of the hinges H2 to H7 of the plate member 102. That is, in the folded form, the magnets 130 and 140 generate greater magnetic forces than the elastic forces occurring from the elastic deformation of the hinges H2 to H7 of the plate member 102.

As described above, according to one or more embodiments, the plate member 102 of the electronics stand 100 are changeable in posture between the expanded form and the folded form. In the expanded form, the first plate 120, the second plate 121, the third plate 125, and the restrictor 122 are all expanded. In the folded form, the second plate 121 is folded with respect to the first plate 120 and placed on the second part 124 such that the second side 121*b* of the second plate 121 supports the back face 1*b* of the electronic device 1, the restrictor 122 restricts the folding of the second plate 121 with respect to the first plate 120, and the third plate 125 is folded in the direction from the second plate 121 to the first plate 120. This places the back face 200*b* of the assembly 200 and the third plate 125 with the gaps S3 in-between.

By such configurations, while the electronics stand 100 supports the electronic device 1, the gaps S3 lie between the third plate 125 and the back face 200*b* of the assembly 200 including the electronic device 1 and the mount 101. Thus, another electronic device such as the information terminal 300 having a thickness corresponding to the gaps S3 is insertable into the gaps S3. That is, one or more embodiments can provide the electronics stand 100 which enables another electronic device to be disposed between the electronics stand 100 and the back face 1*b* of the electronic device 1 supported by the electronics stand 100.

In one or more embodiments, for example, the second plate 121 includes the two connections 121*ba* connected to the third plate 125, and the protrusion 121*c* including the support 121*bb*, located between the two connections 121*ba*, and protruding from the two connections 121*ba*. The third plate 125 is provided with the recess 125*c* in which the protrusion 121*c* is received in the expanded form.

With such configuration, the second plate 121 and the third plate 125 can be more firmly connected together than the third plate 125 and the second plate 121 connected through a single connection 121*ba*.

In one or more embodiments, for example, the mount 101 includes the wall 110 covering at least part of the back face 1*b* of the electronic device 1, and the support 121*bb* contacts the wall 110 in the folded form.

With such configuration, for example, the folding angle of the second plate 121 with respect to the mount 101 can be more accurately set than the support 121*bb* contacting the back face 1*b* of the electronic device 1.

In one or more embodiments, for example, the expanded plate member 102 can cover the front face 1*a* of the electronic device 1.

With such configuration, the expanded plate member 102 can protect the front face 1*a* of the electronic device 1 by covering that. The expanded plate member 102 may cover the front face 1*a* of the electronic device 1 entirely or partly.

The above embodiments have described the example of gaps S3 at two (multiple) locations, however, is not limited to such an example. The gaps S3 may be at one location or three or more locations, for example. In the above embodiments, the gaps S3 are open upward and laterally between both lateral ends of the plate member 102 and the assembly 200 by way of example. One or more embodiments are, however, not limited to such an example. For example, the gaps S3 may be open upward but not open laterally between both lateral ends of the plate member 102 and the assembly 200. Alternatively, for example, the gaps S3 may be open upward but not open laterally between a crosswise center of the plate member 102 and the assembly 200.

According to one aspect of this disclosure, while the electronics stand supports the electronic device, the gap lies between the third plate and the back face of the assembly including the electronic device and the mount. Thereby, another electronic device of a thickness corresponding to the gap can be inserted in the gap. That is, it is made possible to attain the electronics stand that enables another electronic device to be disposed between the electronics stand and the back face of the electronic device supported by the electronics stand.

According to one aspect of this disclosure, it is made possible to more firmly connect the second plate and the third plate than the third plate connected to the second plate through a single connection, for example.

According to one aspect of this disclosure, it is made possible to more accurately set a folding angle of the second plate with respect to the mount than the support contacting the back face of the electronic device, for example.

According to one aspect of this disclosure, the expanded plate member can protect the front face of the electronic device by covering it.

In accordance with one aspect of this disclosure, for example, it is made possible to attain an electronics stand that enables another electronic device to be placed between the electronics stand and the back face of an electronic device supported by the electronics stand.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions. Specifications including configurations or forms (structure, kind, direction, type, size, length, width, thickness, height, number, arrangement, position, material, and the like) can be appropriately modified for implementation.

Although the disclosure has been described with respect to only a limited number of embodiments, those skilled in the art, having benefit of this disclosure, will appreciate that various other embodiments may be devised without departing from the scope of the invention. Accordingly, the scope of the invention should be limited only by the attached claims.

What is claimed is:

1. An electronics stand, comprising:

a mount on which an electronic device is mounted, wherein the mount and the electronic device are an assembly; and a plate member coupled to the mount, wherein the plate member comprises:

a first plate having a first side connected to the mount and a second side opposite the first side;

a second plate having a first side foldably connected to the second side of the first plate and a second side opposite the first side of the second plate;

a restrictor including a first part foldably connected to the first plate and a second part foldably connected to the first part and to the second plate; and a third plate having a first side foldably connected to the second plate, the second side of the second plate includes a connection connected to the third plate and a support located anterior to the connection in a direction from the first side of the second plate to the second side of the second plate, and the plate member changes in posture between an expanded form and a folded form, wherein the expanded form is a form where the first plate, the second plate, the third plate, and the restrictor are expanded and the folded form is a form where the second plate is folded with respect to the first plate and placed on the second part such that:

the support of the second plate supports a back face of the electronic device;

the restrictor limits folding of the second plate with respect to the first plate;

the third plate is folded from the second plate toward the first plate; and a back face of the assembly and the third plate are placed with a gap in-between.

2. The electronics stand according to claim 1, wherein the connection comprises two connections, each of the two connections connected to the third plate, the second plate includes a protrusion that:

includes the support;

is located between the two connections; and protrudes from the two connections, and the third plate comprises a recess in which the protrusion is received in the expanded form.

3. The electronics stand according to claim 1, wherein a wall of the mount covers at least part of the back face of the electronic device, and the support contacts the wall in the folded form.

4. The electronics stand according to claim 1, wherein the plate member covers a front face of the electronic device in the expanded form.

* * * * *